United States Patent [19]

Whitman

[11] 4,041,637

[45] Aug. 16, 1977

[54] PAPER CLIP CONSTRUCTION TOY

[76] Inventor: Robert S. Whitman, 6407 Beacon St., Pittsburgh, Pa. 15219

[21] Appl. No.: 585,186

[22] Filed: June 9, 1975

[51] Int. Cl.[2] ..... A63H 33/00

[52] U.S. Cl. ..... 46/16

[58] Field of Search ..... 46/16, 17; 35/19 A, 35/27, 28; 273/157 R

[56] References Cited

U.S. PATENT DOCUMENTS

| | | | |
|---|---|---|---|
| 2,545,409 | 3/1951 | McCall | 273/157 R |
| 2,984,488 | 5/1961 | Kirchner | 35/27 |
| 3,663,923 | 5/1972 | Primoff et al. | 35/19 A |

FOREIGN PATENT DOCUMENTS

| | | | |
|---|---|---|---|
| 1,169,821 | 5/1964 | Germany | 46/16 |

*Primary Examiner*—F. Barry Shay

*Attorney, Agent, or Firm*—Buell, Blenko & Ziesenheim

[57] ABSTRACT

A game board is provided in the form of a planar board member having a plurality of equally spaced pegs of substantially uniform height and thickness on one surface and located at the intersections of equally spaced apart transverse sets of parallel lines, said pegs being spaced so that a conventional paper clip spans at least two pegs in any line and a plurality of paper clips engaged over adjacent pegs to form a design.

3 Claims, 6 Drawing Figures

PAPER CLIP CONSTRUCTION TOY

This invention relates to games and particularly to a game board and paper clip combination which provides a unique construction game in which a great variety of forms can be produced.

Game boards for construction type games have been known in various forms. Generally, however, they have been relatively complex in their structure and equipment and as a result have not only been relatively expensive but also have limited flexibility in the art and geometric forms which can be produced. For example, Sonsikowski et al, U.S. Pat. No. 1,136,625 shows a game board with pegs set into the board, each peg being grooved to receive special shaped plates which are inserted within the peg grooves to form different patterns. Abbey, U.S. Pat. No. 3,596,377 shows a game board apertured to receive pegs and rings to produce varied designs. Boards of this type are expensive to produce and require special accessories which, if lost, are frequently difficult to replace.

I have invented a game in which the board is very simple in construction and the accessories are simply ordinary paper clips, which, if lost, are readily replaced.

I preferably provide a planar board member, a plurality of equally spaced vertical pegs of substantially uniform height and thickness, said pegs being located at the intersections of equally spaced apart parallel lines running in transverse directions, said intersections being generally spaced apart so that a conventional paper clip spans at least two pegs in any straight line, and a plurality of paper clips engaged over adjacent pegs to form a design. Preferably, the pegs are arranged so that a paper clip will span three pegs in a given line. The board and pegs are preferably formed of rigid plastic in contrasting color to the paper clips. The pegs are frictionally engaged by said paper clips to retain them in place.

In the foregoing general description I have set out certain objects, purposes and advantages of my invention. Other objects, purposes and advantages of my invention will be evident from the following description and accompanying drawings in which.

Figure 2:
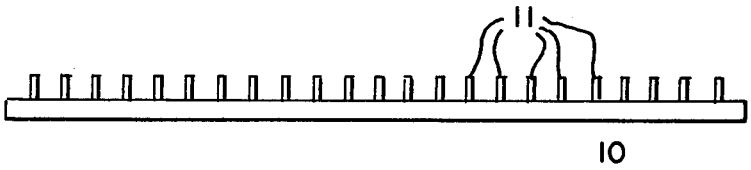
FIG. 2 is a side elevation of the board of FIG. 1.
Figure 1:
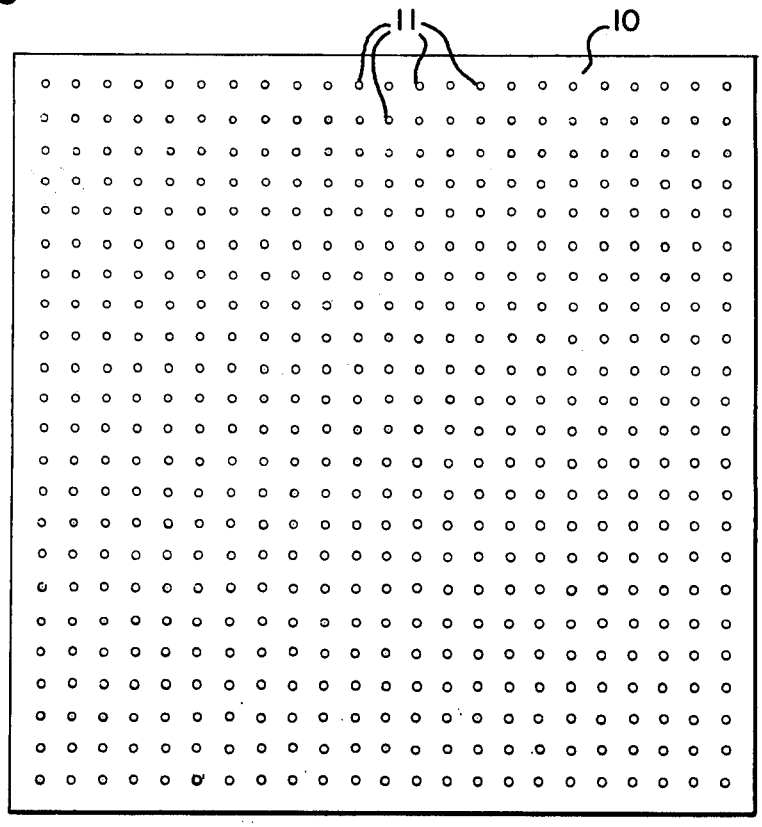
FIG. 1 is a top plan view of a board according to my invention.

Referring to the drawings, I have illustrated a plane flat board 10 of plastic having equal spaced pegs 11 at the junction of parallel lines running normal to each other across the board. The pegs are spaced so that a paper clip 12 placed over them in any line well embrace at least three of the spaced pegs in a given line.

Figure 3:
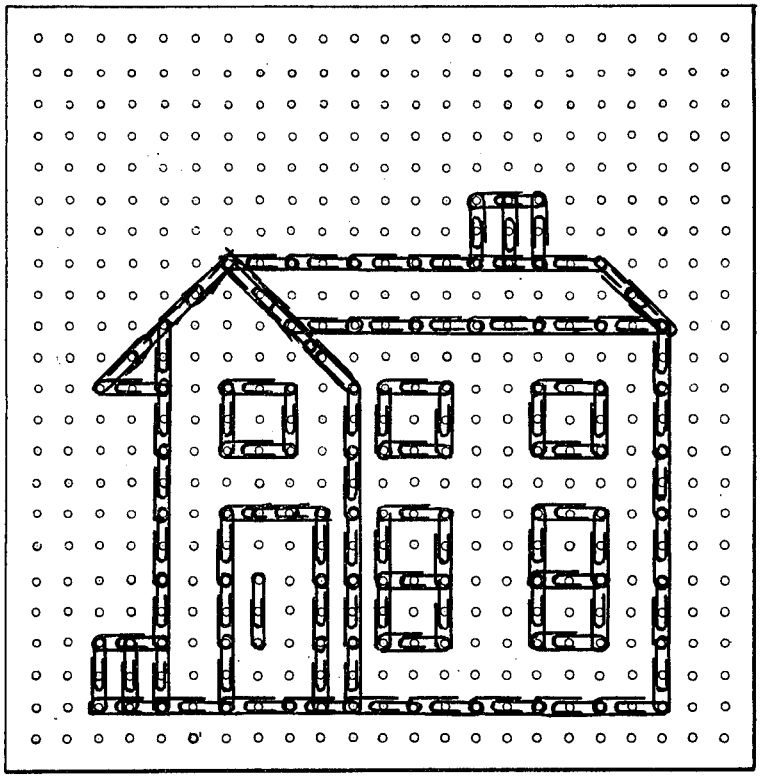
FIGS. 3–6 are top plan views of the board of FIG. 1 showing three different configurations of paper clips on the board of this FIG. 1.
Figure 4:
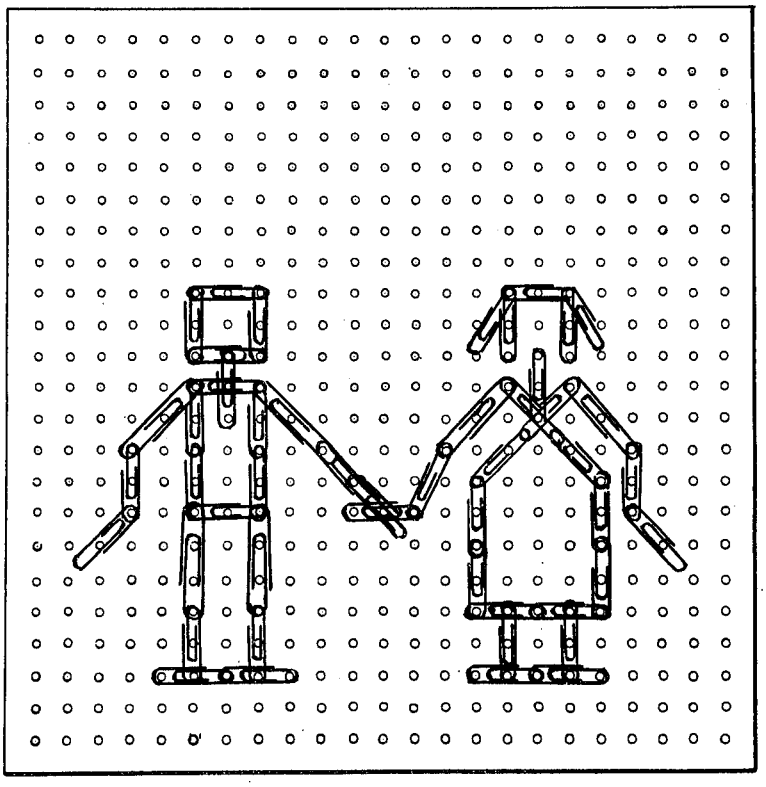
Figure 5:
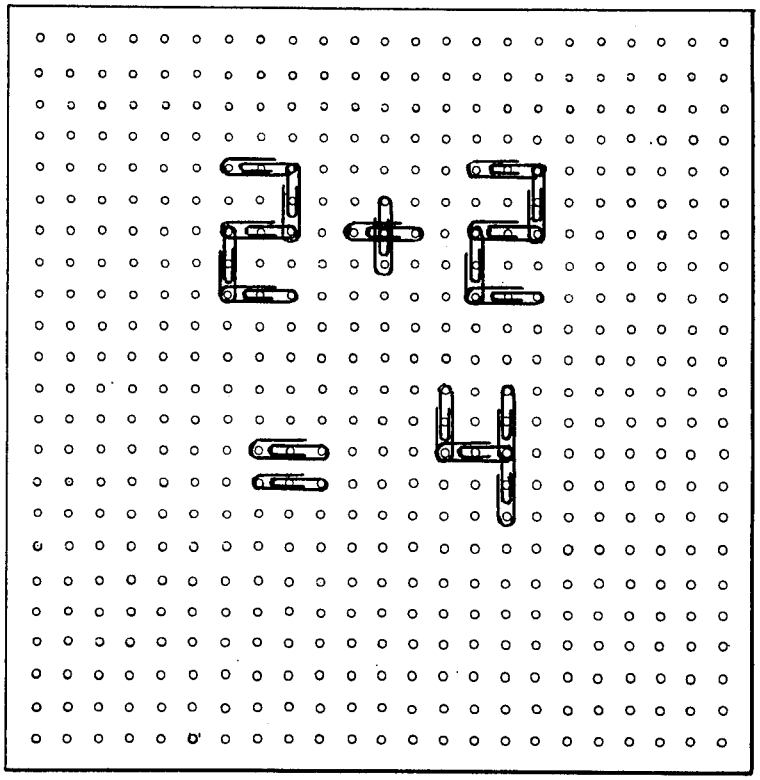
Figure 6:
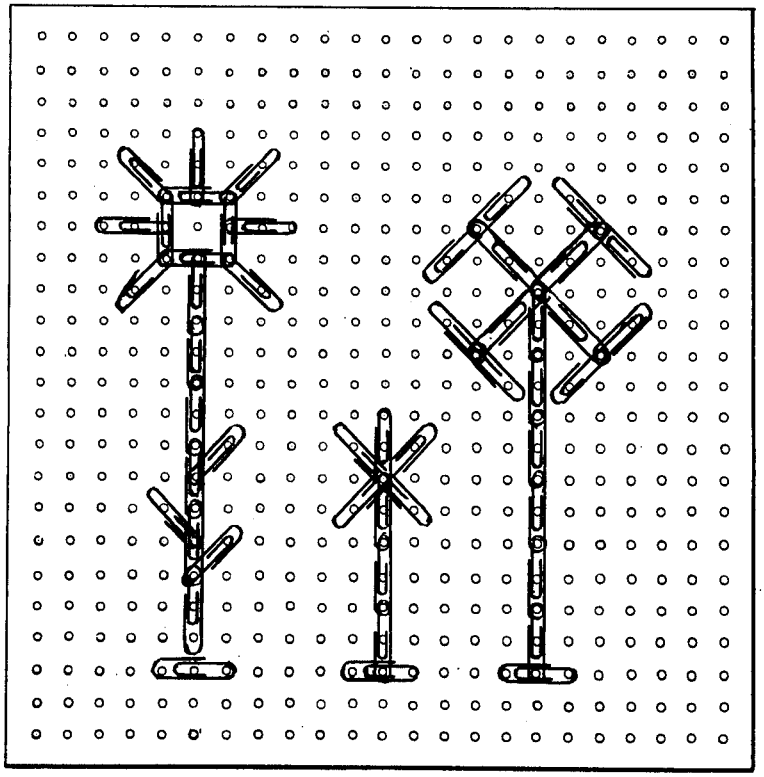

The paper clips can be placed over the pegs in a great variety of configurations, for example the house of FIG. 3, the children of FIG. 4, the mathematical addition of FIG. 5, the flower of FIG. 6. The combinations are limitless and as can be seen the game is not only artistic but educational. It can be used to teach mathematics; to teach the alphabet; to teach spelling; art forms; geometric forms and a vast array of other forms and subjects. In short, it has the greatest versatility, with the least cost in original form and upkeep of any construction type game known to me.

While I have set out certain preferred embodiments of my invention in the foregoing specification, it will be obvious that this invention may be otherwise embodied within the scope of the following claims:

I claim:

1. A game board for construction type games comprising a planar board member, a plurality of equally spaced generally perpendicularly projecting pegs all of substantially uniform height and cross section on one surface of said board, said pegs being located at the intersections of equally spaced apart sets of transverse parallel lines, said intersections and pegs being generally spaced apart so that a conventional paper clip spans at least two pegs in any straight line and a plurality of paper clips engaged over adjacent pegs to form a design, said adjacent pegs being frictionally engaged by said paper clips.

2. A game board as claimed in claim 1 wherein the pegs are arranged so that a paper clip spans three pegs in any straight intersecting line on the board.

3. A game board as claimed in claim 1 wherein the board and pegs are formed of rigid plastic in contrasting color to the paper clips.

* * * * *